United States Patent [19]

Dexter

[11] Patent Number: 4,459,935

[45] Date of Patent: Jul. 17, 1984

[54] PHANTON COMPUTER GATING SYSTEM

[75] Inventor: Fred A. Dexter, San Diego, Calif.

[73] Assignee: The United States of America as represented by the Secretary of the Navy, Washington, D.C.

[21] Appl. No.: 344,236

[22] Filed: Jan. 29, 1982

[51] Int. Cl.[3] ..... B63G 8/38

[52] U.S. Cl. ..... 114/340; 307/129; 361/203

[58] Field of Search ..... 114/339, 340; 307/129; 324/326, 327; 361/182, 203

[56] References Cited

U.S. PATENT DOCUMENTS

| | | | |
|---|---|---|---|
| 2,983,852 | 5/1961 | Gray | 361/203 X |
| 3,128,416 | 4/1964 | Rode | 361/203 X |
| 3,136,307 | 6/1964 | Richard | 361/203 X |
| 3,215,900 | 11/1965 | Harvey | 361/203 X |
| 3,355,631 | 11/1967 | Christiansen | 361/203 X |
| 3,596,163 | 7/1971 | Barrett | 318/588 |
| 3,657,629 | 4/1972 | Lloyd | 318/647 |
| 3,725,760 | 4/1973 | Bailey | 318/568 |
| 3,732,465 | 5/1973 | Palmer | 361/203 X |
| 3,742,328 | 6/1973 | Ohta | 318/685 |
| 3,986,104 | 10/1976 | Randolph, Jr. | 324/327 |
| 4,179,087 | 12/1979 | Johnson | 244/175 |
| 4,214,539 | 7/1980 | Herr | 112/158 E |
| 4,238,829 | 12/1980 | Martin | 364/561 |

*Primary Examiner*—Sherman D. Basinger

*Attorney, Agent, or Firm*—Robert F. Beers; Ervin F. Johnston; Harvey Fendelman

[57] ABSTRACT

A system for gating a computer to receive navigational information from the position sensors of the periscope assembly of a submarine is disclosed. A first coil is connected as the load coil of an oscillator and is mounted in a stationary position on a submarine bulkhead. A second coil is secured to the periscope assembly and moves up and down with the periscope, in and out of magnetic coupling with the first coil. A third coil is secured to the periscope assembly and moves up and down with the periscope assembly. A fourth coil is secured to the rotatable periscope assembly and remains magnetically coupled to the third coil while the periscope is either rotated or moved up and down. A normally opened switch button on the periscope handle is electrically connected to the fourth coil. Depression of the switch button results in a load on the oscillator which is otherwise normally tuned to the same frequency as a second oscillator. Loading of the first oscillator coil causes the first oscillator to operate at a different frequency from the second oscillator. This difference is detected by a frequency comparator, the output of which is connected to a relay. Depression of the normally opened switch on the periscope handle results in deactuation of the relay. A set of switch contacts are opened in response to deactuation of the relay permitting entry of position data into the computer navigational system from the periscope position sensors.

16 Claims, 2 Drawing Figures

PHANTON COMPUTER GATING SYSTEM

BACKGROUND OF THE INVENTION

The present invention relates generally to the field of computer gating systems and to the field of submarine navigational plotting systems and also generally to the field of switching systems. More particularly, the present invention relates to a system for gating information from the position sensors of a periscope assembly of a submarine into a navigational computing system.

Many submarines today have selsyn motors or other position sensors which monitor the position of the periscope assembly. For instance, onboard the USS Dolphin is a periscope that is used to position the Dolphin relative to other ships and landmarks during various sea test situations. The periscope is tied to an onboard computer by means of selsyn motors. The computer takes the information from the selsyn motors and produces a navigational plot. The computer is designed such that it only accepts the information from the selsyn motors when it is instructed to gate this information in. The present method of doing this gating is to have an operator at the computer keyboard key in the command from the navigation officer who is taking the sitings through the periscope. This method is slow and cumbersome in that it requires a separate communication from the navigation officer through the keyboard operator to instruct the keyboard operator to key in the gating command. Further, since the periscope tube is gas pressurized, and since the periscope assembly is movable in up and down directions as well as being rotatable, there has been no practical way to directly hardwire a computer gating switch onto the periscope assembly.

SUMMARY OF THE INVENTION

The present invention overcomes the foregoing problems by utilization of a system of magnetic coupling that does not require a direct wired connection between the push button and the computer gate. Further, the gating system of the present invention comprises components that are attached to the periscope and periscope housing which are completely passive and may be made splash proof to withstand the environment around the periscope when it is in the down position.

The present invention is comprised of a small electronics package that is attached to the submarine overhead in the vicinity of the periscope. This electronics package contains a power supply that operates two oscillators and a frequency comparator-detector circuit and provides a normally closed set of contacts which prevent the input of information into the navigational computing system. One of the oscillators drives an external coil which is also mounted on the overhead. This coil couples to a second coil that is mounted on the topside of the periscope hoist assembly. This second coil in turn is electrically connected to a third coil mounted on the bottom side of the hoist assembly and embodied as an annular coil circumscribing the gas filled periscope tube. Inside of the third coil a fourth coil is positioned which is also annular and which also circumscribes the gas filled periscope tube. The fourth coil is magnetically coupled to the third coil and is mechanically connected to the rotatable portion of the periscope. This fourth coil is electrically connected to a capacitor and a push-button switch located on the handle of the periscope.

When the periscope is in the up position, the first coil is magnetically coupled to the second coil. If the push button on the handle is pushed, this creates an out of phase load on one of the oscillators which causes that oscillator to move from its natural frequency. In response to this change in frequency, a relay is deactivated, resulting in opening of the normally closed set of contacts thereby permitting entry of data into the computer navigational system.

Due to the fact that the present invention utilizes magnetic coupling, the periscope assembly can be turned to any position without slip rings or dangling wires.

OBJECTS OF THE INVENTION

Accordingly, it is the primary object of the present invention to disclose a switching system suitable for use in environments where electrical power may not be utilized.

It is a concomitant object of the present invention to disclose a novel computer gating system.

It is a still further object of the present invention to disclose a switching system for utilization on a periscope assembly.

It is a still further object of the present invention to disclose a switching system for utilization on a rotatable member which does not require the use of slip rings.

These and other objects of the invention will become more readily apparent from the ensuing specification when taken together with the drawings.

DESCRIPTION OF THE PREFERRED EMBODIMENT

Figure 1:
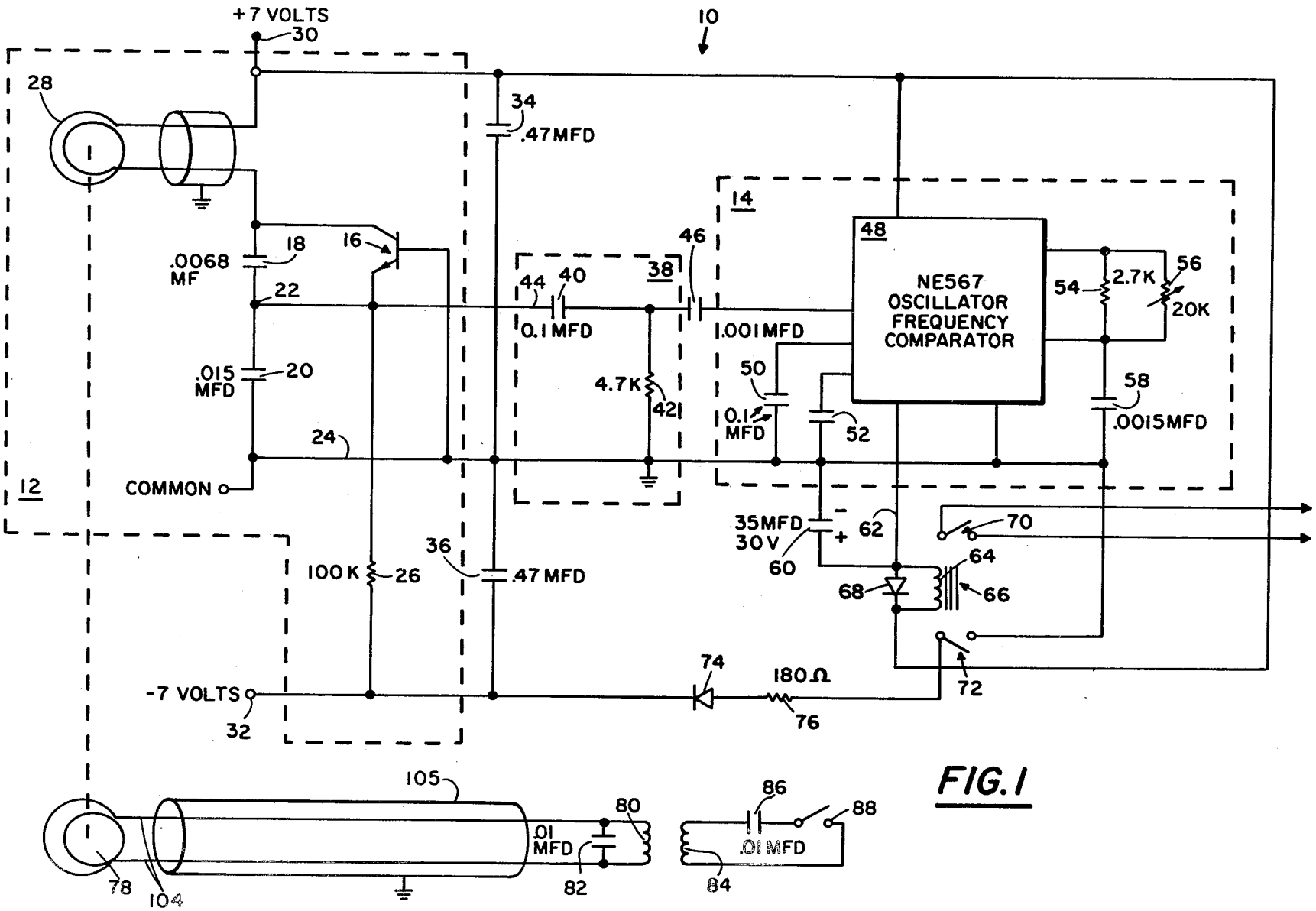
FIG. 1 is a network diagram of the present invention.

Referring now to FIG. 1 the network of the present invention will be described. The computer gating system 10 of the present invention is comprised of a first oscillator 12 and a second oscillator 14. The first oscillator 12 is comprised of an NPN transistor 16 having its collector connected to one end of capacitor 18 and having its emitter connected to the other terminal of capacitor 18. A second capacitor 20 is connected to the juncture 22 at one terminal and to ground 24 at its other terminal. Also, the base of transistor 16 is connected to ground as illustrated. The emitter resistor 26 is also included in the oscillator. Finally, the oscillator includes a load coil 28 connected between the positive voltage supply 30 illustrated as being a +7 volt voltage supply, and the collector of transistor 16. Oscillator 12 is also supplied with power from negative voltage supply 32 illustrated as being −7 volts. It is to be understood that although a specific embodiment of the oscillator 12 has been illustrated and described, other types of oscillators could be utilized within the scope of the present invention. Filter capacitors 34 and 36 are connected between the power supplies 30 to 32 and ground 24 as illustrated. A further filter 38 comprised of capacitor 40 and resistor 42 is connected to the output terminal 44 of the oscillator 12 and to ground 24. Filter 38 is connected to the second oscillator 14 via a coupling capacitor 46. The oscillator 14 is comprised of an oscillator-frequency comparator 48 integrated circuit such as model NE567 commercially available from General Electric and National Semiconductor. The oscillator 14 also includes the capacitors 50 and 52 connected as illustrated to the oscillator-frequency comparator 48 and to ground. An R-C network comprised of resistor 54, variable resistor 56 and capacitor 58 are connected to the oscillator-frequency comparator 48 as illustrated and to ground. The frequency of oscillation of the oscillator 14 is variably controlled by means of the variable resistor 56. A bypass filtering capacitor 60 is connected between ground and the output terminal 62 of the oscillator 14.

The output 62 of the oscillator 14 is connected to the coil 64 of relay 66 and thence to the positive power supply 30 as illustrated. A back EMF protection diode 68 is connected across the coil 64 as illustrated. Relay 66 also includes a set of ganged contacts 70 and 72. Contacts 70 are connected across the gating network of the computer gating system and are normally closed as will be described to short the input to the computer gating system thereby preventing information from entering the computer. A light emitting diode 74 is connected to the negative voltage supply 32 at its cathode and its anode is connected to the set of contacts 72 via the current limiting resistor 76.

Figure 2:
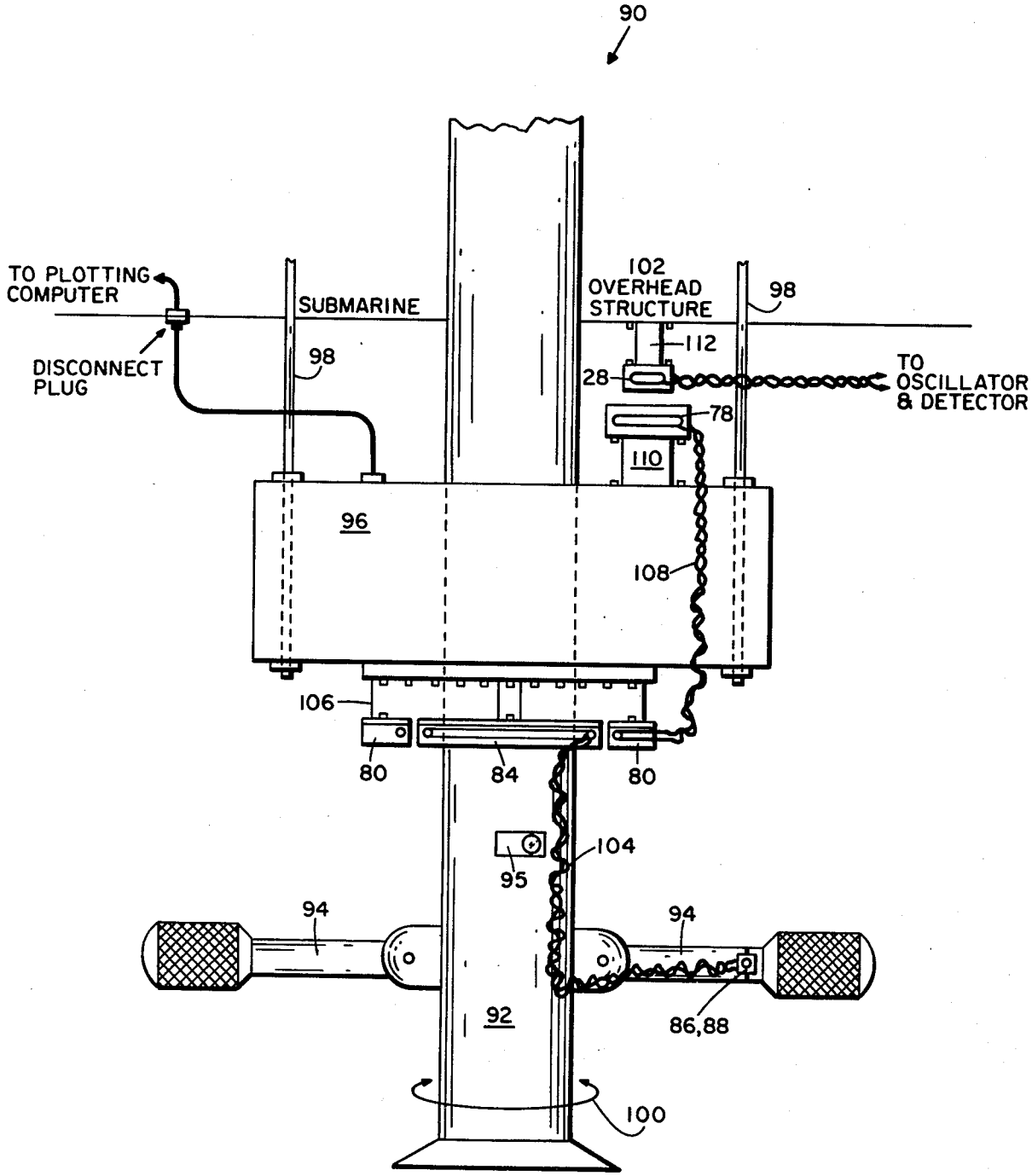
FIG. 2 is a front view schematic diagram of a periscope assembly employing the present invention.

A second coil 78 is placed so as to be selectively positionable within the magnetic field of coil 28 as will be further described with respect to FIG. 2. Coil 78 is connected in series with coil 80 which is shunted by capacitor 82. Coil 84 is in magnetic coupling with coil 80 and is connected in series with capacitor 86 and push button position mark switch 88 as is illustrated.

Referring now to FIG. 2, the positioning and mounting of the various components described in FIG. 1 will be described with respect to a submarine periscope assembly. As seen in FIG. 2, the periscope assembly 90 is comprised of a gas pressurized periscope column 92 which has attached to it periscope handles 94 as is well known. The periscope assembly 90 also includes an eye piece viewing aperture 94 and a hoist assembly 96. The hoist assembly 96 is supported and drawn by hoist cables 98. The hoist assembly 96 has enclosed therein (not shown) selsyn sending generators as is well known. These selsyn sending generators are utilized to create servo signals for transmission to the navigational computing system for production of a navigational plot as is well known. As is also well known the hoist assembly 96 as well as the periscope column 92 are moveable in unison in up and down directions. Periscope column 92 is also rotatable as indicated by the arrow 100. The periscope assembly 90 is part of a submarine or other vehicle which includes an overhead structure 102 or bulkhead.

As is seen in FIG. 2, the position mark switch 88 and capacitor 86 are mounted on one side of the handles 94 of the periscope assembly 90. The switch 88 is connected via wire 104, which may include shielding 105, to the coil 84. The coils 80 and 84 are mounted in concentric arrangement as illustrated and are embodied as annular coils surrounding the periscope column 92 and supported by support fixture 106 which is secured to the hoist assembly 96 by suitable means such as bolting as illustrated. The coils 80 and 84 may be enclosed within plastic compartments or other suitable means to insulate them from moisture and the environment. Coil 80 is connected via conductors 108 to the coil 78 which is mounted via mounting bracket 110 on the top side of the hoist assembly 96. Coil 28 is mounted via mounting bracket 112 to the overhead structure 102 as illustrated. The periscope assembly 90 as depicted in FIG. 2 is in the up position. In this position, it is seen that the coil 78 is sufficiently close to the coil 28 so as to be magnetically coupled to it. It can easily be envisioned that when the periscope assembly 90 is put in the down position, the coils 28 and 78 will be separated by sufficient distance so that they are no longer magnetically coupled. The remaining components including the oscillators 12 and 14, the filter 44, the power supplies 30 and 32, the LED 74, resistor 76, relay 66, back EMF protection diode 68 and capacitor 60 are mounted on a circuit card (not shown) which may be secured to the overhead structure 102 of the submarine or other vehicle.

Referring now to FIGS. 1 and 2 simultaneously the operation of the present invention will be described. Assuming power from the power supplies 30 and 32 is on, oscillator 12 will begin to oscillate at some frequency $f_1$ depending upon the values of the oscillator components which are chosen. Likewise, when power is supplied to the oscillator 14 it will oscillate at some frequency which may be varied by varying the resistance of variable resistor 56. By so varying the resistance of resistor 56, the frequency of oscillation of oscillator 14 may be tuned so as to be identical or substantially identical to the frequency of oscillation of oscillator 12. When the frequency of oscillation of oscillator 14 is matched to that of oscillator 12, oscillator-frequency comparator 48 provides an output signal on output terminal 62. This output signal on output terminal 62 results in the energization of relay 66 which, when so energized, acts to close its sets of ganged contacts 70 and 72. It is noted at this point that diode 68 is backed biased and therefore nonconductive. When the set of contacts 72 is closed pursuant to actuation of relay 66, current flows through LED 74 thereby providing an indication to the operator that the system has been energized. Also, closure of the set of contacts 70 causes shorting of the computer gating system and thereby prevents the computer (not shown) from receiving information from the selsyn sending generators contained within the hoist assembly 96.

Assuming that the periscope assembly 90 is in the up position, coil 78 will be magnetically coupled to coil 28. When the navigation officer desires to send position information to the navigation computer, he depresses position mark switch 88 which thereby closes the circuit including the coil 84. By reason of the fact that coil 84 is magnetically coupled to coil 80 and by reason of the fact that coil 80 is connected in series with coil 78 and that coil 78 is magnetically coupled to coil 28, closure of switch 88 results in a change in the inductive load on the oscillator 12. This change in the inductive load creates an out of phase load on the oscillator 12 which causes oscillator 12 to move from its natural frequency. When this happens, oscillator 12 no longer will oscillate at the same frequency as that of oscillator 14. The frequency comparator within the oscillator-frequency comparator 48 detects this change of frequency of oscillator 12 and, in response to this change in frequency, discontinues its output signal on terminal 62. When this happens, relay 66 is de-energized and the set of contacts 70 are opened. Opening of the set of contacts 70 removes the short from the input of the computer gating system and thereby permits information from the selsyn motors contained within hoist assembly 96 to be transferred to the navigational computer.

It can thus be appreciated that a novel switching system has been disclosed for utilization especially on a gas pressurized periscope column in which there is no electrical energy transmitted in the area of the gas pressurized column. Moreover, it can be readily appreciated that the navigational computer can be gated to receive position information from the area of the periscope column without the use of slip rings.

It is noted that in FIG. 1 specific component values for each of the resistors, capacitors and power supplies of the system have been illustrated. Although, such specific values have been included, it is to be understood that the present invention is not limited to these values and that these values are submitted by way of example only and that other values may be used depending upon the particular requirements. Obviously, many modifications and variations of the present invention are possible in the light of the above teachings. It is therefore to be understood that within the scope of the appended claims the invention may be practiced otherwise than as specifically described.

What is claimed is:

1. A switching system comprising:

a first oscillator;

a second oscillator including a frequency comparator operably coupled to said first oscillator;

a relay having a winding operably coupled to said second oscillator and having a set of contacts;

first means operably coupled to said first oscillator for varying the output frequency of said first oscillator;

said frequency comparator being operable for providing an output signal to said relay when the output frequency of said first oscillator is substantially the same as the output frequency of said second oscillator.

2. The switching system of claim 1 wherein:

said second oscillator includes second means for varying the output frequency of said second oscillator.

3. The switching system of claim 1 wherein:

said first oscillator includes a load coil.

4. The switching system of claim 3 wherein said first means comprises:

a first coil selectively positionable to be magnetically coupled to said load coil;

a second coil connected to said first coil;

a third coil magnetically coupled to said second coil; and a switch connected in series with said third coil.

5. The switching system of claim 4 wherein:

said contacts of said relay are normally closed when said relay is energized.

6. The switching system of claim 5 wherein:

said switch is normally open and wherein closure of said switch causes said relay to de-energize and causes said contacts to open.

7. The switching system of claims 4, 5 or 6 further comprising:

a periscope assembly having a gas pressurized periscope column and a periscope hoist assembly;

said third coil being mounted on said gas pressurized periscope column.

8. The switching system of claim 7 wherein:

said second coil is secured to said periscope hoist assembly.

9. The switching system of claim 8 wherein:

said switching system further comprises an overhead structure that is stationary with respect to said hoist assembly; and said load coil is secured to said overhead structure.

10. The switching system of claim 9 wherein:

said third coil is positioned within said second coil.

11. The switching system of claim 10 wherein:

said third and second coils surround said gas pressurized periscope column.

12. The switching system of claim 11 wherein said third coil is mounted on said gas pressurized periscope column so as to be rotatable with respect to said second coil.

13. The switching system of claim 11 wherein:

said periscope assembly has a periscope up position and a periscope down position: and said first and load coils are positioned such that they are magnetically coupled when said periscope assembly is in said periscope up position and such that they are not magnetically coupled when said periscope assembly is in said periscope down position.

14. The switching system of claim 9 wherein:

said switch is positioned on said periscope assembly.

15. The switching system of claim 1 wherein:

said second oscillator includes an output; and said relay winding is operably coupled to said output of said second oscillator.

16. In a navigational plotting system for a submarine including a periscope assembly having a periscope column, a periscope hoist assembly, a set of periscope handles and a submarine overhead structure, the improvement comprising:

a switch secured to said set of periscope handles;

a first coil connected to said switch and secured to said periscope column so as to be rotatable therewith;

a second coil magnetically coupled to said first coil and secured to said periscope hoist assembly;

a third coil connected to said second coil and secured to said hoist assembly;

a fourth coil secured to said overhead structure; and means connected to said fourth coil and having a first condition and a second condition and for responding to closure of said switch to change from said first condition to said second condition.

* * * * *